US006371020B1

(12) United States Patent
Schaede

(10) Patent No.: US 6,371,020 B1
(45) Date of Patent: Apr. 16, 2002

(54) WEB GUIDING ROLLER

(75) Inventor: Johannes Georg Schaede, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/589,598

(22) PCT Filed: Dec. 8, 1998

(86) PCT No.: PCT/DE98/03640

§ 371 Date: Jun. 12, 2000

§ 102(e) Date: Jun. 12, 2000

(87) PCT Pub. No.: WO99/29507

PCT Pub. Date: Jun. 17, 1999

(30) Foreign Application Priority Data

Dec. 8, 1998 (DE) ..... 197 55 317

(51) Int. Cl.[7] ..... B41F 13/54
(52) U.S. Cl. ..... 101/228; 101/225
(58) Field of Search ..... 101/228, 231, 101/232, 416.1, 225

(56) References Cited

U.S. PATENT DOCUMENTS

| | | | | |
|---|---|---|---|---|
| 3,060,853 A | | 10/1962 | Remer | |
| 4,271,379 A | | 6/1981 | Eckelmeyer | |
| 4,781,116 A | | 11/1988 | Harada | |
| 5,320,042 A | * | 6/1994 | Schwopfinger | 101/416.1 |

FOREIGN PATENT DOCUMENTS

| | | |
|---|---|---|
| DE | 18 73 638 | 6/1963 |
| DE | 29 51 246 | 7/1980 |
| GB | 2 189 435 | 10/1987 |
| JP | 57-193368 | 11/1982 |

* cited by examiner

*Primary Examiner*—Ren Yan
(74) *Attorney, Agent, or Firm*—Jones, Tullar & Cooper, PC

(57) ABSTRACT

A web guiding system for a web-fed rotary printing press includes a web guide roller which contacts the printed surface of a print-carrying web. The effective diameter of the transfer cylinder which prints the print-carrying web is the same as, or is an integral multiple of the diameter of the web guide roller.

9 Claims, 1 Drawing Sheet

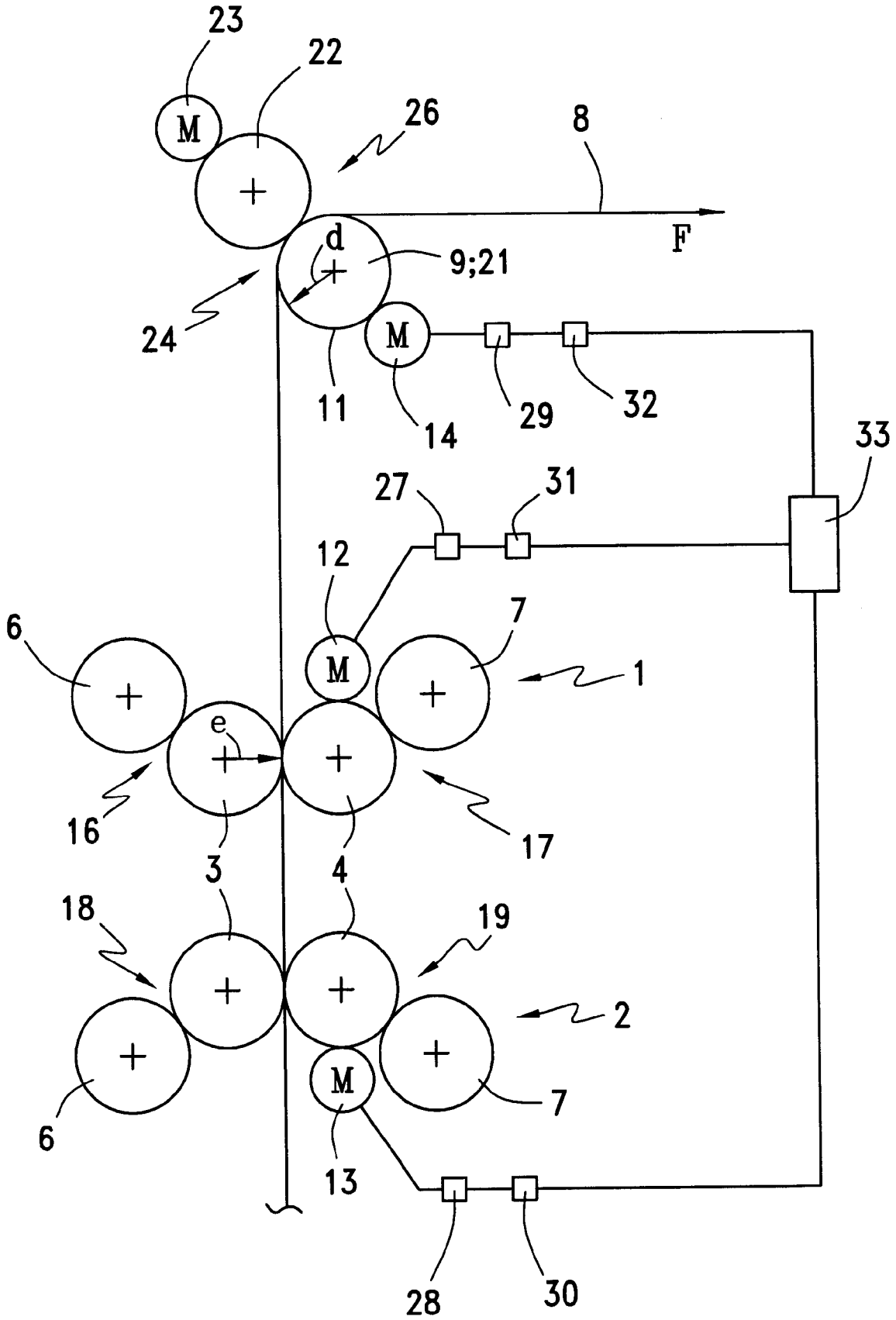
23
22
26
8
M
F
d
9;21
24
M
11
14
29
32
33
27
31
12
7
6
M
1
e
16
3
4
17
18
19
2
6
M
7
13
28
30

WEB GUIDING ROLLER

FIELD OF THE INVENTION

The present invention relates to a web guide roller for a web-fed rotary printing press. The print carrying web is guided over a driveable web guide roller with its printed side in contact with the web guide roller. The printed surface of the web is not smudged.

DESCRIPTION OF THE PRIOR ART

A web-fed rotary printing press is known from DE 29 51 246 C2. This prior device has at least one paper guide roller for reversing the paper web downstream of the last print unit in the running direction.

When the printed side of the paper web comes into contact with the paper guide roller, ink deposits occur on the paper guide roller, which can result in smudging of the printed image.

JP-A-57-193368 describes guide rollers whose diameter is equal to the diameter of a rubber blanket cylinder of a print unit.

SUMMARY OF THE INVENTION

The object of the present invention is based on providing a web guide roller.

In accordance with the present invention, the object is attained by the provision of at least one driveable web guide roller whose surface contacts the printed side of the print carrying web. The size of the web guide roller, and its rotational speed are selected so that there is no smudging of the print image on the print carrying web as it comes in contact with the web guiding roller.

The advantages which can be achieved by the present invention consist, in particular, in that the printed print-carrying web does not cause any deposit of printing ink on the web guide roller and therefore no smudging of the print image occurs when the printed web comes into contact with the web guide roller. This is achieved, on the one hand, by an oleophobic surface, for example made of chromium of the web guide roller, and on the other hand in that the web guide roller has an oleophilic surface such as a rubber packing or rubber cover. Thus, possible ink deposits on the surface of the web guide roller now occur harmlessly always at the same location.

BRIEF DESCRIPTION OF THE DRAWING

The present invention will be explained in greater detail in what follows by means of a preferred embodiment. The sole drawing FIGURE shows the schematic representation of print units of a web-fed rotary printing press with a web guide roller in accordance with the present invention.

At least two known print units 1, 2, with four printing groups 16, 17, 18, 19 of, for example, a so-called tower of eight, are arranged on top of each other in a web-fed rotary printing press. Each printing group 16 to 19 has respectively, one transfer cylinder, for example a rubber blanket cylinder 3 or 4, and respectively, one printing cylinder, for example plate cylinders 6 or 7. The cylinders 3, 4, 6, 7 of each printing group 16 to 19 are connected with each other by means of known toothed gears, for example.

Printing in one color each can be performed with each respective printing group 16 to 19, which individual colors are supplied to the plate cylinders 6 or 7 by respective ink ducts, not specifically represented. Moreover, it is also possible to assign damping units, not specifically represented, to each plate cylinder 6 or 7 of the printing groups 16 to 19. Each of the rubber blanket cylinders 3, 4 can be placed against the other, or respectively against a passing print-carrying web, for example a paper web 8.

After leaving the print units 1, 2, the paper web 8 is guided in the running direction F over a web guide roller, such as, for example, a paper guide roller 9, and is reversed in the process. In this case, the paper web 8 rests against or contacts the surface of the paper guide roller 9 over an angle of, for example, 90 or less/greater. The paper guide roller 9 has an exterior radius d, which corresponds to and is the same as the effective exterior radius e of a rubber blanket cylinder 3 or 4.

The radius e of the transfer cylinder 3 or 4 corresponds to an effective conveying radius e, on whose basis the conveying speed of the paper web 8 can be fixed as a function of the number of revolutions of the transfer cylinder.

In printing operations, this radius e is less than a radius of the rubber blanket cylinder in a free state of the rubber blanket cylinder. In a technical sense, the effective radius e of the rubber blanket cylinder, in printing operations, is equal to the radius e of the web guide roller, i.e. tolerances are permissible as long as no slippage occurs on the rubber blanket cylinder and on the web guide roller. Such tolerances only result in negligible changes of the web tension.

The paper guide roller 9 has either an oleophilic surface 11, i.e. it is provided with a rubber blanket, for example, or has an oleophobic surface 11, for example a chromium cover.

In accordance with a first preferred embodiment, the print units 1, 2, as well as the paper guide roller 9, are each connected with separate angle of rotation-position controlled drive mechanisms, for example motors 12, 13, 14. An angle of rotation sensor, 27, 28, 29 is assigned to each motor 12 to 14. Each motor 12 to 14 and each position sensor is connected with a drive regulator, 30, 31, 32. All drive regulators 30, 31, 32 are connected with each other via a data bus 33. By means of this arrangement of angle of rotation sensors 27, 28, 29; drive regulators 30, 31, 32; and data bus 33, an angular synchronicity is provided between the rubber blanket cylinder 3 or 4 of the print unit 1, as well as between the rubber blanket cylinder 3 or 4 of the print unit 2, and the paper guide roller 9, in that all can be driven at the same conveying speed.

In accordance with a second preferred embodiment, each one of the print units 1 and 2 is connected via a coupling, via a bevel gear, via a synchronizing or vertical shaft, via a vertical shaft coupling and via a bevel gear with a synchronizing or longitudinal shaft all of which are not specifically represented. The couplings can be known, register-maintaining couplings and can each consist of an upper and of a lower coupling plate. The rubber blanket cylinder 3 or 4 of each printing group 16 to 19 is provided with an absolute value sensor, which, by known electronic means, signals only one possible angular position of the driven rubber blanket cylinder 4 for the synchronous coupling-in of the printing group. The absolute value sensor consists of a circular disk with angular division. In place of the absolute value sensor, it is also possible to use a known so-called one-value coupling, which also permits the coupling process in only one possible angular position.

In connection with an advantageous preferred embodiment, the circumference of the paper guide roller 9 can be adaptable to the effective circumference of the rubber-elastic packing of the rubber blanket cylinder 3 or 4 in order to compensate for possible tolerances. For this purpose, the paper guide roller 9 may have a circumferentially adjustable rubber- or plastic coated surface 11, which is not specifically shown.

The circumferential adjustability is achieved, for example, by the use of a circumferentially variable cylinder-like support element, which has a number of shell segments. These shell segments are embodied in a wedge-like manner on their inside and cooperate with counter wedges arranged in the axial direction of the guide roller 9. A cylindrical helical spring has been threaded on this support element. One end of this spring is connected with the guide roller shaft, and the other end of this spring is connected with a tensioning device in order to change the circumference of the helical spring.

In accordance with a further preferred embodiment, an oleophilic paper guide roller 9 can also have an endless rubber coating, a so-called sleeve.

In the same way, it is possible to produce an oleophilic paper guide roller 9 in which a cylinder base body is surrounded by a shell-like support plate carrying a rubber blanket. The angled legs of the support plate are held in a secant-like slit of the cylinder base body.

In accordance with another preferred embodiment, the oleophobic surface of a paper guide roller 9 which is, for example, coated with chromium, can be made with an adjustable circumference in that initially the shaft journals are provided with rotatable inlets. In this way, a heatable liquid, for example water or oil, can be passed through the roller interior.

By appropriate heating of the liquid, and the different heat expansion connected with this, it is possible to change the radius d, or the circumference of the paper guide roller 9 by a few millimeters. Possible tolerance variations between the circumferences of the rubber blanket cylinders 3 or 4 and the paper guide roller 9 can be compensated by means of this heating of the guide roller 9.

It is finally also possible, in accordance with the present invention, that the radius d of the driveable paper guide roller 9 is selected to correspond to a whole number fraction 1/n (for example wherein n=2) of a radius e, for example ha ½ portion, of a rubber blanket cylinder 3 or 4 of a printing group 16 to 19. In this case, a plate cylinder 6 or 7 of the printing group 16 to 19 has approximately the radius d of the paper guide roller 9. This is also possible with double circumference presses and double productions, i.e. with two identical subjects on the circumference of the printing cylinder, or respectively plate cylinder 6 or 7.

The circumferential speed of the rubber blanket cylinders 3 or 4 and of the driven paper guide cylinder 9 can be equal. A possible deposit of ink from the printed surface of the web 8 to the surface 11 of the guide roller 9 always takes place at the same location on the surface 11, or respectively on the circumference of the paper guide roller 9, and therefore will have only a harmless effect.

Alternatively, the radius d of the driveable paper guide roller 9 can correspond to a whole number multiple, for example twice that of an effective radius e of a rubber blanket cylinder 3 or 4 of a printing group 16 to 19, wherein the circumferential speed is respectively the same.

The driveable paper guide roller, or respectively web guide roller 9, can also act as a traction roller 21. In a special case, it is possible to assign a counter roller 22 which, when required, can be driven by a motor 23, to the traction roller 21 driven by the motor 14. The counter roller 22 can also be seated in support arms, not specifically represented, and can be designed so, that it can be placed against the traction roller 21 by use of a spring force. The motor 23 can also be flanged to the counter roller 22, and the motor 14 can also be flanged to the paper guide roller 9.

Finally, it is also possible to use the driveable paper guide roller, or respectively web guide roller 9, together with the driveable counter roller 22 as a web catching device 24.

If, for example, the paper web 8 tears at an imagined tear spot 26 located downstream of the web catching device 24, the web guide roller 9 can roll up the paper web 8, which is now pushed up in the running direction F, until the web-fed rotary printing press has come to a stop.

While preferred embodiments of a web guiding roller in accordance with the present invention have been set forth fully and completely hereinabove, it will be apparent to one of skill in the art that a number of changes in, for example, the type of printing cylinders used, the style of printing being done, and the like could be made without departing from the true spirit and scope of the present invention which is accordingly to be limited only by the following claims.

What is claimed is:

1. A web-fed rotary printing press comprising:

at least one printing group for printing a printed image on a print-carrying web passing through said at least one printing group;

at least one transfer roller in said at least one printing group, said transfer roller having a transfer cylinder surface and a transfer cylinder free radius, said transfer cylinder further having a transfer cylinder effective radius defined as a radius of said at least one transfer cylinder during printing of the printed image on the print carrying web as the print carrying web passes through said at least one printing group, said effective radius being less than said free radius;

at least one driveable web guide roller located after, in a web running direction said at least one printing group to receive the print carrying web with the printed image from said at least one printing group, said at least one web guide roller having a web guide surface touching a printed side of the print-carrying web and having a web guide roller radius which, during operation of said at least printing group, is equal to said transfer cylinder effective radius; and means for driving said web guide roller and said transfer cylinder in angular synchronicity, the printed image printed on the printed side of the print carrying web by said at least one printing group always contacting the same location on said web guide surface of said at least one web guide roller.

2. The web-fed rotary printing press of claim 1 wherein said web guide roller surface is oleophobic.

3. The web-fed rotary printing press of claim 1 wherein said web guide roller has a rubber-coated surface.

4. A web-fed rotary printing press comprising:

at least one printing group for printing a printed image on a print-carrying web passing through said at least one printing group;

at least one printing cylinder in said printing group, said at least one printing cylinder having a printing cylinder diameter;

at least one transfer cylinder in said at least one printing group, said at least one transfer cylinder having a transfer cylinder surface and a transfer cylinder free radius, said transfer cylinder further having a transfer cylinder effective radius defined as a radius of said at least one transfer cylinder during printing of the printed image on the print carrying web as the print carrying web passes through said at least one printing group, said effective radius being less than said free radius;

at least one driveable web guide roller located after, in a web running direction said at least one printing group to receive the print carrying web with the printed image from said at least one printing group, said at least one web guide roller having a web guide surface touching a printed side of the print-carrying web and having a web guide roller radius and diameter, said web guide roller radius, during operation of said at least one printing group, being equal to a whole number fraction (1/n) of said transfer cylinder effective radius, said web guide roller diameter being approximately said printing cylinder diameter; and means for driving said web guide roller and said transfer cylinder in angular synchronicity, the printed image printed on the printed side of the print carrying web by said at least one printing group always contacting the same location on said web guide surface of said at least one web guide roller.

5. The web-fed rotary printing press of claim 4 wherein said web guide roller surface is oleophobic.

6. The web-fed rotary printing press of claim 4 wherein said web guide roller has a rubber-coated surface.

7. A web-fed rotary printing press comprising:

at least one printing group for printing a printed image on a print-carrying web passing through said at least one printing group;

at least one transfer cylinder in said at least one printing group, said at least one transfer cylinder having a transfer cylinder surface and a transfer cylinder free radius, said transfer cylinder further having a transfer cylinder effective radius defined as a radius of said at least one transfer cylinder during printing of the printed image on the print carrying web as the print carrying web passes through said at least one printing group, said effective radius being less than said free radius;

at least one driveable web guide roller located after, in a web running direction said at least one printing group to receive the print carrying web with the printed image from said at least one printing group, said at least one web guide roller having a web guide surface touching a printed side of the print-carrying web and having a web guide roller radius, wherein during printing operation of said at least one printing group, said web guide roller radius is equal to a whole number multiple of said transfer cylinder effective radius operating under a load of said at least one printing group; and means for driving said web guide roller and said transfer cylinder in angular synchronicity, the printed image printed on the printed side of the print carrying web by said at least one printing group always contacting the same location on said web guide surface of said at least one web guide roller.

8. The web-fed rotary printing press of claim 7 wherein said web guide roller surface is oleophobic.

9. The web-fed rotary printing press of claim 7 wherein said web guide roller rubber-coated surface.

* * * * *